US007810810B2

(12) United States Patent
Hantel et al.

(10) Patent No.: US 7,810,810 B2
(45) Date of Patent: Oct. 12, 2010

(54) APPARATUS FOR PRESSING FLAT MATERIALS ONTO A TRANSPORT MODULE

(75) Inventors: Ulrich Hantel, Berlin (DE); Wolfgang Muhl, Hohen Neuendorf (DE); Michael Winck, Birkenwerder (DE); Dieter Wölm, Ludwigsfelde OT Gross Schulzendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 0 days.

(21) Appl. No.: 12/257,918

(22) Filed: Oct. 24, 2008

(65) Prior Publication Data

US 2009/0152802 A1 Jun. 18, 2009

(30) Foreign Application Priority Data

Dec. 17, 2007 (DE) ..... 10 2007 060 734

(51) Int. Cl.
*B65H 5/00* (2006.01)

(52) U.S. Cl. ..... 271/264

(58) Field of Classification Search ..... 271/264
See application file for complete search history.

(56) References Cited

U.S. PATENT DOCUMENTS 3,748,442 A * 7/1973 Lovendusky ..... 235/475
3,924,847 A 12/1975 Pescetto
4,746,234 A 5/1988 Harry
4,903,954 A * 2/1990 Robertson et al. ..... 271/7
5,011,129 A * 4/1991 Holbrook ..... 271/274
5,121,916 A * 6/1992 Sanchez ..... 271/272
5,467,709 A * 11/1995 Salomon ..... 101/93
5,575,465 A * 11/1996 Auerbach et al. ..... 271/9.13
5,813,326 A 9/1998 Salomon
5,880,747 A 3/1999 Bartenwerfer et al.
5,949,444 A 9/1999 Geserich et al.
6,343,786 B1 * 2/2002 Gregoire et al. ..... 271/273
6,364,306 B1 * 4/2002 Kunde et al. ..... 271/2
6,431,778 B1 8/2002 Coudray et al.

(Continued)

FOREIGN PATENT DOCUMENTS

DE 2 327 932 12/1974

(Continued)

OTHER PUBLICATIONS

European Search Report dated Sep. 1, 2010.

*Primary Examiner*—Patrick Mackey
*Assistant Examiner*—Prasad V Gokhale
(74) *Attorney, Agent, or Firm*—Laurence A. Greenberg; Werner H. Stemer; Ralph E. Locher

(57) ABSTRACT

An apparatus for pressing flat materials onto a transport module includes pressing elements acting on the flat material with a spring force through an opening in a feed table for flat materials. The feed table is mounted above a lower housing shell. The pressing elements are configured as spring elements which can be lowered and are anchored in the lower housing shell. An actuating element is disposed in an indentation of a front wall of the lower housing shell in order to actuate a lowering apparatus disposed in the lower housing shell. The lowering apparatus has a lever connected mechanically to the actuating element and a slide coupled to the lever for lowering the spring elements upon actuation of the actuating element.

7 Claims, 5 Drawing Sheets

U.S. PATENT DOCUMENTS

| | | | | |
|---|---|---|---|---|
| 6,467,901 | B2 | 10/2002 | Von Inten | |
| 6,550,994 | B2 | 4/2003 | Manduley | |
| 6,585,433 | B2 | 7/2003 | Davies et al. | |
| 6,776,089 | B2 | 8/2004 | Kanda | |
| 7,147,223 | B2 * | 12/2006 | Fukuchi | 271/274 |
| 7,464,931 | B2 * | 12/2008 | Hammer et al. | 271/264 |
| 2003/0094749 | A1 * | 5/2003 | Kallin et al. | 271/264 |
| 2004/0178566 | A1 * | 9/2004 | Kulpa | 271/226 |
| 2005/0264606 | A1 | 12/2005 | Kulpa et al. | |
| 2006/0220294 | A1 * | 10/2006 | Sye | 271/2 |

FOREIGN PATENT DOCUMENTS

| | | | |
|---|---|---|---|
| DE | 233 101 | B5 | 10/1995 |
| DE | 196 05 014 | C1 | 3/1997 |
| DE | 196 05 015 | C1 | 3/1997 |
| DE | 603 01 078 | T2 | 1/2006 |
| EP | 1 079 975 | B1 | 3/2001 |
| EP | 1 170 141 | B1 | 1/2002 |
| FR | 2 742 693 | A1 | 6/1997 |
| WO | 99/44174 | A1 | 9/1999 |

* cited by examiner

APPARATUS FOR PRESSING FLAT MATERIALS ONTO A TRANSPORT MODULE

CROSS-REFERENCE TO RELATED APPLICATION

This application claims the priority, under 35 U.S.C. §119, of German Patent Application DE 10 2007 060 734.4, filed Dec. 17, 2007; the prior application is herewith incorporated by reference in its entirety.

BACKGROUND OF THE INVENTION

Field of the Invention

The invention relates to an apparatus for pressing flat materials onto a transport module. The invention is used in printing apparatuses which are controlled by a microprocessor and is suitable for franking machines and other mail processing units.

An apparatus which employs a transport principle and has a belt that lies at the top and a sprung back pressure apparatus that lies underneath, between which an item of mail is clamped, is known from East German Patent Application DD 233 101 B5, corresponding to U.S. Pat. No. 4,746,234. However, a thermal transfer ink ribbon which is used is unsuitable as a transport belt. The thermal transfer ink ribbon is disposed above a feed table, over which the items of mail are transported in a lying manner downstream in the direction of the mail flow. The feed table has openings, through which a driven back pressure roller engages on the item of mail.

U.S. Pat. No. 6,550,994 has disclosed a franking machine having a transport apparatus for items of mail, by way of which transport apparatus the letters are transported through the franking machine through the use of a transport belt which lies at the top and a plurality of sprung levers which are disposed underneath. Similar subject matter is also apparent from U.S. Pat. No. 5,813,326, U.S. Pat. No. 6,776,089 and U.S. Pat. No. 6,585,433. The transport belt is mounted in the manner of a loop on rollers and the printing region is disposed next to the transport region which lies between the rollers. The width of the transport belt is relatively small and corresponds to approximately 1 inch. The extent of a housing transversely with respect to the transport direction of the items of mail is relatively great in comparison. An additional factor is that a second printing region is provided for printing franking strips which are rolled up on reels and which are unrolled for printing. The second printing path causes higher production costs and requires a correspondingly greater extent of the housing transversely with respect to the transport direction of the items of mail.

U.S. Pat. No. 5,467,709 has already disclosed a printing apparatus for an inkjet franking machine, in which a franking imprint is printed onto an item of mail through the use of an inkjet print head during approximately horizontal letter transport. The inkjet print head is disposed in a stationary manner behind a guide plate in a recess for printing. A circulating transport belt, which is likewise disposed on the side of the guide plate, serves as a transport apparatus. A supporting and pressing apparatus having a plurality of rollers is disposed on the other side opposite the guide plate, with the result that an item of mail which is fed in is clamped between the rollers of the supporting and pressing apparatus and the circulating transport belt. However, the apparatus cannot avoid oblique running of the printing media. An insufficiently tensioned transport belt or a not exactly parallel alignment of the axles of those rollers, on which the transport belt circulates, is sufficient to involve the above-mentioned risk. The supporting and pressing apparatus is very complicated as a result of the multiplicity of rollers of that apparatus.

German Patent DE 196 05 015 C1, corresponding to U.S. Pat. No. 5,949,444, has already proposed an embodiment of a printing apparatus of an inkjet franking machine which is the JetMail® apparatus of the applicant of the instant application, Francotyp-Postalia AG & Co. That embodiment carries out a franking imprint during non-horizontal, approximately vertical letter transport through the use of an inkjet print head which is disposed in a stationary manner behind a guide plate in a recess. A circulating transport belt having pressing elements for the items of mail (letters up to 20 mm thickness, DIN (German Standard) B4 format) or for franking strips, which are configured in such a way that they can be adhesively bonded to packages of any desired thickness, serves as a transport apparatus. The printing medium (letter, package, franking strip) is clamped between the pressing elements and the guide plate.

Transport and drive apparatuses of relatively simple construction without a back pressure apparatus (see German Patent DE 196 05 014 C1) or with a back pressure apparatus (see International Publication No. WO 99/44174) in the vicinity of the printing region using at least one inkjet print head, have also already been proposed. In International Publication No. WO 99/44174, the latter is disposed downstream of an intake roller pair in the transport direction of the mail flow, with the upper roller being driven and the lower back pressure roller being sprung. A further roller pair downstream of the inkjet print head in the mail flow direction close to an ejection device likewise exerts a force on the printing medium. The printing region is spaced apart from the force transmission region of one of the roller pairs by more than one radius of the respectively driven roller. Although the printing information can in principle be changed in all regions by digital printing, the print quality becomes lower as a higher transport speed is selected. In particular, during the use of two inkjet print heads, an offset in the printed image (butting or connection error) can occur along a printed length in the transport direction. The offset makes evaluation of the printed image by machine difficult. The action of the force of the further roller pair downstream of the inkjet print head in the direction of the mail flow close to the ejection device leads to different distances being covered and therefore to the butting or connection error in the printed image in the case of two inkjet print heads which are offset with respect to one another. The print quality which is required in the context of current programs of mail deliverers (for example, the Information Based Indicia Program of the USPS) would therefore only be possible to achieve at a low printing speed. The low thickness of the printing media which can be printed by a printing apparatus that is constructed simply in that way is also disadvantageous.

European Patent EP 1 079 975 B1, corresponding to U.S. Pat. No. 6,431,778, has disclosed an apparatus for printing characters on a predefined location of one side of a flat recording medium, and has also disclosed a franking machine which is equipped correspondingly. A transport belt is disposed firstly on the inkjet print head side and secondly forms an unsuspended supporting device for that side of a flat recording medium (object, item of mail, envelope) which is to be printed. A back pressure apparatus supports the flat object from below. In that back pressure apparatus, a belt rolls around at least two other rollers, at least one of which is not suspended.

An apparatus which is known from European Patent EP 1 170 141 B1, corresponding to U.S. Pat. No. 6,467,901, for printing a printing medium in the printing region, uses a driven transport drum and nondriven back pressure rollers in the force transmission region or, as an alternative, a nondriven back pressure conveyor belt. In the printing region, a stationary inkjet print head prints the printing medium which is moved downstream, with the inkjet print head being disposed axially with respect to the transport drum. The printing region is preferably approximately 1 inch and is spaced apart from the force transmission region, with the spacing of the most remote pixel from the edge of the transport drum being smaller than the radius of the circumference of the transport drum. However, the slight approximately linear contact of that surface of the item of mail which is to be printed with the transport drum and an intake wheel for items of mail which is disposed at a spacing are disadvantageous. The intake wheel is driven by the transport drum through a toothed belt. This causes a $\Delta x$ offset of the dots in the printed image. A $\Delta y$ offset of the dots in the printed image results orthogonally with respect thereto, in particular in the case of items of mail having a very large format. Moreover, the construction causes high production costs.

As is known, a franking machine includes, inter alia, an electronic part (meter) and the transport apparatus for items of mail having an electronic controller. A keyboard and a display unit of the meter are connected to the electronic part. The electronic controller is connected electrically to a drive of the transport apparatus in order to actuate it. An electric motor having a gear mechanism is used for the drive, for example. The transport apparatus has a transport belt which acts with a predefined adhesive friction on a part of the surface of the flat materials or items of mail. That part of the surface is not printed but is close to the printing region.

In the market segment of franking machines having small to medium mail item throughputs, a compact transport apparatus for items of mail is required, in which the items of mail are not to be contaminated, however, by free spraying. In the case of horizontal mail item transport, it is assumed that an ink cartridge is disposed above a printing window in the z-direction of a Cartesian coordinate system counter to the direction of gravity. During printing, at least one inkjet print head ejects ink droplets in the direction of gravity, counter to the z-direction, and those ink droplets fly through the printing window. The printing window is disposed at the edge of a transport belt in the y-direction in a housing part, with the transport belt transporting a flat material which is to be printed at the edge past the at least one print head in the transport direction x during printing.

SUMMARY OF THE INVENTION

It is accordingly an object of the invention to provide an apparatus for pressing flat materials onto a transport module of a printing apparatus which is controlled by a microprocessor, in which friction is high at a transport belt of the transport module and low at the pressing apparatus, and which overcomes the hereinafore-mentioned disadvantages of the heretofore-known devices of this general type. Firstly postcards and secondly C4-sized letters having a mail item thickness of up to 10 mm are to be processed by the printing apparatus with a high print quality, low production costs and a medium mail item throughput, with the accessibility to the flat materials being ensured even in the case of a jam.

A transport module is disposed above a feed table in the z-direction and has a transport belt for items of mail or flat printing materials in a manner which is known per se.

With the foregoing and other objects in view there is provided, in accordance with the invention, an apparatus for pressing flat materials onto a transport module. The apparatus comprises pressing elements which act on the flat material with a spring force through an opening in a feed table for flat materials. The feed table is mounted above a lower housing shell. The pressing elements are configured as spring elements which can be lowered, and are anchored in the lower housing shell. Suitable pressing from below onto the transport belt of the transport module is realized by spring elements which are known per se and are disposed below the transport belt in the transport direction. An actuating element is disposed in an indentation of the front wall of the lower housing shell in order to actuate a lowering apparatus which is disposed in the lower housing shell. The lowering apparatus has a lever which is connected mechanically to the actuating element and a slide which is coupled to the lever and lowers the spring elements when the actuating element is actuated. The spring elements can compensate for letter thicknesses of up to 10 mm. A mail item jam can be remedied simply by lowering the spring elements.

Other features which are considered as characteristic for the invention are set forth in the appended claims.

Although the invention is illustrated and described herein as embodied in an apparatus for pressing flat materials onto a transport module, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
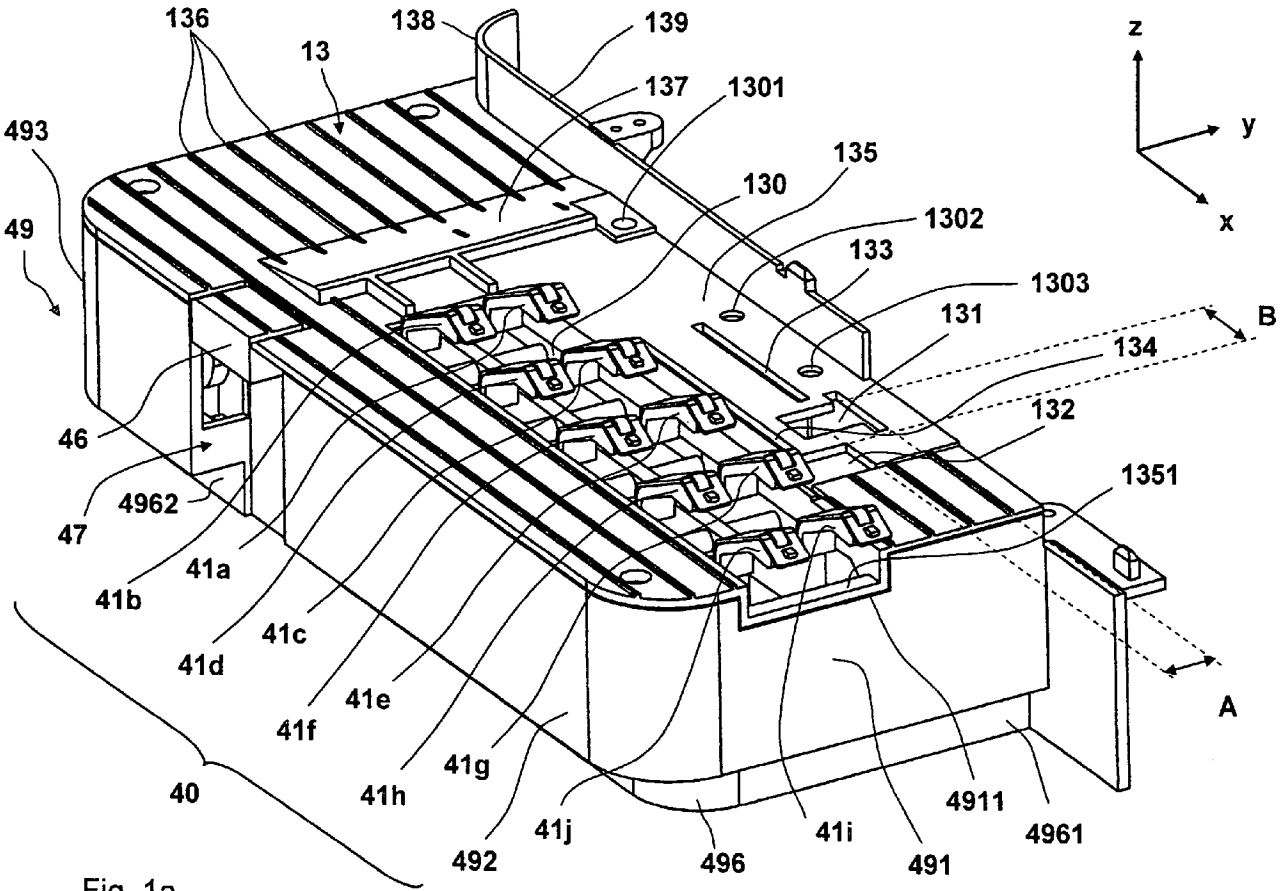
FIG. 1A is a diagrammatic, perspective view of an apparatus for pressing flat materials onto a transport module, as seen from the front at the top and the right.

Referring now to the figures of the drawings in detail and first, particularly, to FIG. 1A thereof, there is seen a perspective view of an apparatus for pressing flat materials onto a transport module, as seen from the front at the top and right.

A non-illustrated item of mail or flat material can be fed in above a feed table 13. The above-mentioned transport module is disposed above the feed table 13 but has not been shown. The transport module has a transport belt for transporting items of mail or flat materials in a manner which is known per se.

A pressing apparatus 40 is disposed below the feed table 13 and acts on the underside of the fed item of mail or flat material in the z-direction through a large rectangular opening 130 of the feed table 13. Spring elements 41*a* to 41*j* are shown in an operating position and not lowered. Lowering is provided for eliminating a jam of items of mail or flat materials.

On an inlet side in a flow of mail, the feed table 13 has sliding rails 136 in a feed region. The sliding rails 136 are integrally formed on a base plate 135 and reduce sliding friction for fed flat materials. A ramp 137, which raises a front edge of the fed flat materials, is disposed between the feed table and the rectangular opening 130. The ramp 137 forms a lock together with a non-illustrated plate. The plate is disposed parallel to the base plate 135 above the latter and serves as an upper guide for flat materials. Flat materials can therefore be pushed in only up to a defined thickness. A guide wall 139 is integrally formed on the base plate 135 in the feed region. The guide wall 135 extends in the transport direction, extends orthogonally in the upward direction (z-direction) and is widened in an inlet region 138 for flat materials or items of mail. The latter are detected through the use of sensors after passing the ramp 137. Holes 1301, 1302 and 1303, which are provided for transmitting diodes of the sensors, are integrally formed in the base plate 135. The transmitting diodes and phototransistors or photodiodes are a constituent part of transmitted light barriers.

The base plate 135 is disposed after the ramp 137 in a mail item transport direction x and has a first opening 131 of medium size and a second opening 132 of medium size opposite inkjet print heads. The first opening 131 is disposed offset in comparison with the second opening 132 by a first spacing A in the y-direction, that is to say in a direction transverse with respect to the mail item transport direction. The first spacing A is somewhat smaller than an entire print head length of a ½" HP print head. The second opening 132 is disposed offset in comparison with the first opening 131 by a second spacing B in the x-direction, that is to say in the mail item transport direction. The spacing B is more than an entire print head width. Both the first and second openings 131 and 132 in the feed table 13 are π-shaped (pi-shaped). A respective elongate rectangular opening 133, 134 is positioned upstream of each of the two first and second openings 131 and 132 in the mail flow direction.

The surface area of the large rectangular third opening 130 exceeds the surface area of the second opening 132 of medium size by more than one order of magnitude. The second opening 132 is offset in the y-direction with respect to the third opening 130 and the offset is so minimal that both openings adjoin one another directly or are separated only by a very thin connecting web. The third opening 130 permits the spring elements 41*a* to 41*j* of the pressing apparatus 40, which presses in a sprung manner against a flat material or item of mail and is disposed below the feed table 13, to pass through it. The feed table 13 is mounted on a lower housing shell 49. The lower housing shell 49 has a right-hand side wall 491, a front wall 492, a left-hand side wall 493 and a base 496. The right-hand side wall 491 has a cutout 4911 at an upper edge for the spring elements 41*i* and 41*j* which can be lowered downstream in the mail flow direction. The feed table 13 is stepped downward at a frame 1351 which lies downstream in the mail flow direction, in such a way that the frame 1351 delimits the third opening 130 and fits into the cutout 4911 at the upper edge of the right-hand side wall 491. The right-hand side wall 491 is formed offset in the transport direction with respect to a right-hand base side wall 4961. A base front wall 4962 is formed offset in the y-direction by the same offset with respect to the front wall 492.

The front wall 492 has an indentation 47, in which the wall is set back as far as the base front wall 4962. An actuating element 46, which is disposed in the indentation 47, has a surface that ends with the running face of the feed table 13.

Figure 1B:
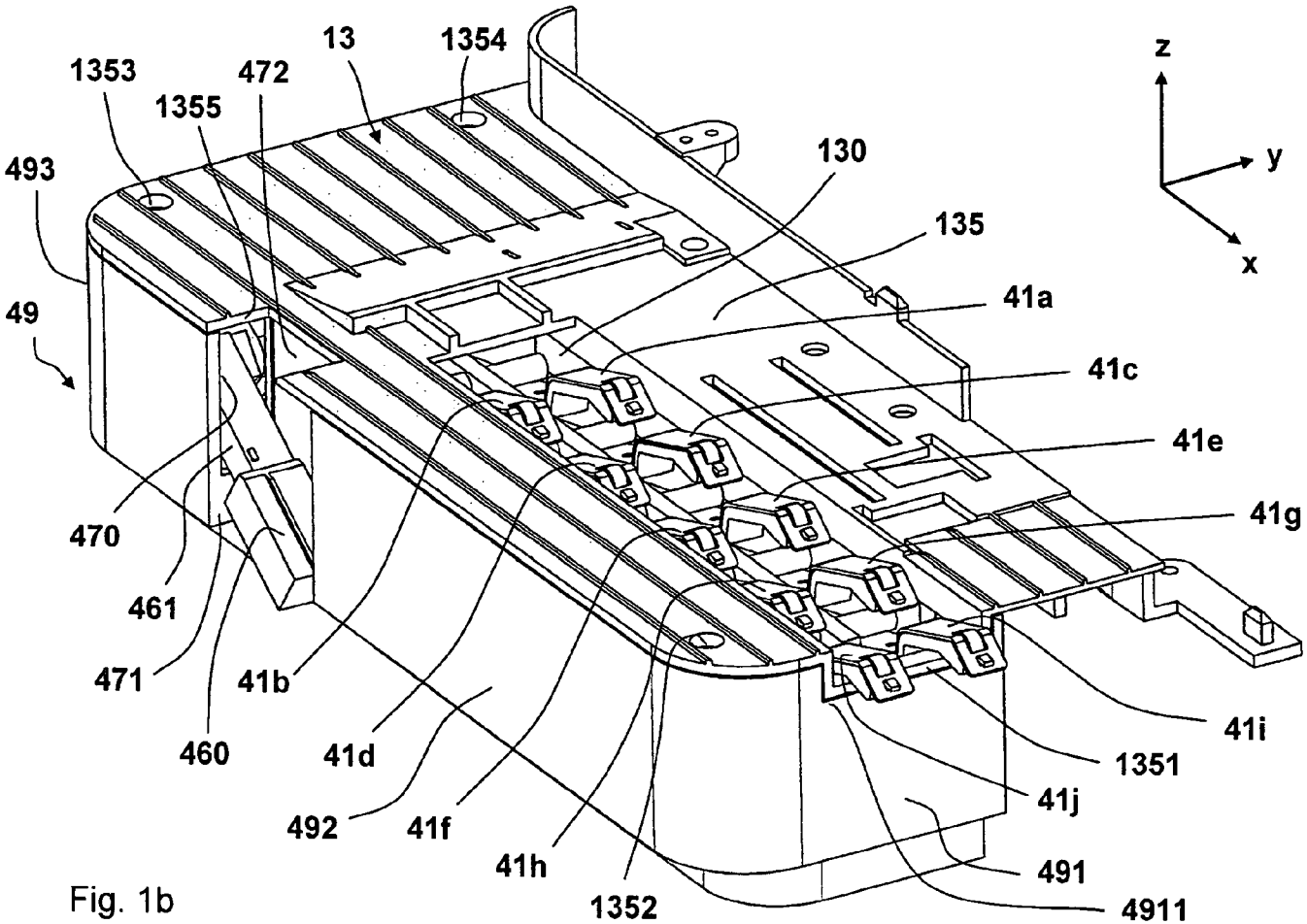
FIG. 1B is a perspective view of an apparatus for pressing flat materials onto a transport module, as seen from the front at the top and the right with lowered spring elements.

FIG. 1B is a perspective view of an apparatus for pressing flat materials onto a transport module, as seen from the front at the top and right, with lowered spring elements. The spring elements 41*a* to 41*j* in the third opening 130 of the feed table 13 are shown lowered in the transport direction (x-direction) and in the direction of gravity (counter to the z-direction) and lie below the feed table. The frame 1351 in the cutout 4911 at the upper edge of the right-hand side wall 491 therefore has a downwardly stepped configuration. The feed table 13 is mounted on the lower housing shell 49 through the use of non-illustrated screws passing through holes 1352, 1353 and 1354 in the base plate 135. The hole 1354 is disposed close to the left-hand side wall 493 and the holes 1352 and 1353 are disposed close to the front wall 492 on the feed table 13.

The base plate 135 of the feed table 13 has a fourth opening 1355 on the front wall 492. The fourth opening 1355 permits the actuation of the actuating element 46 having a surface 460 with a structure which is the same as that of the surface of the feed table 13. The actuating element 46 has a power arm 461 which emerges from an opening 470 of the left-hand side wall 471 of the indentation 47. The pressing apparatus 40 will be explained in detail in the following text.

Figure 1C:
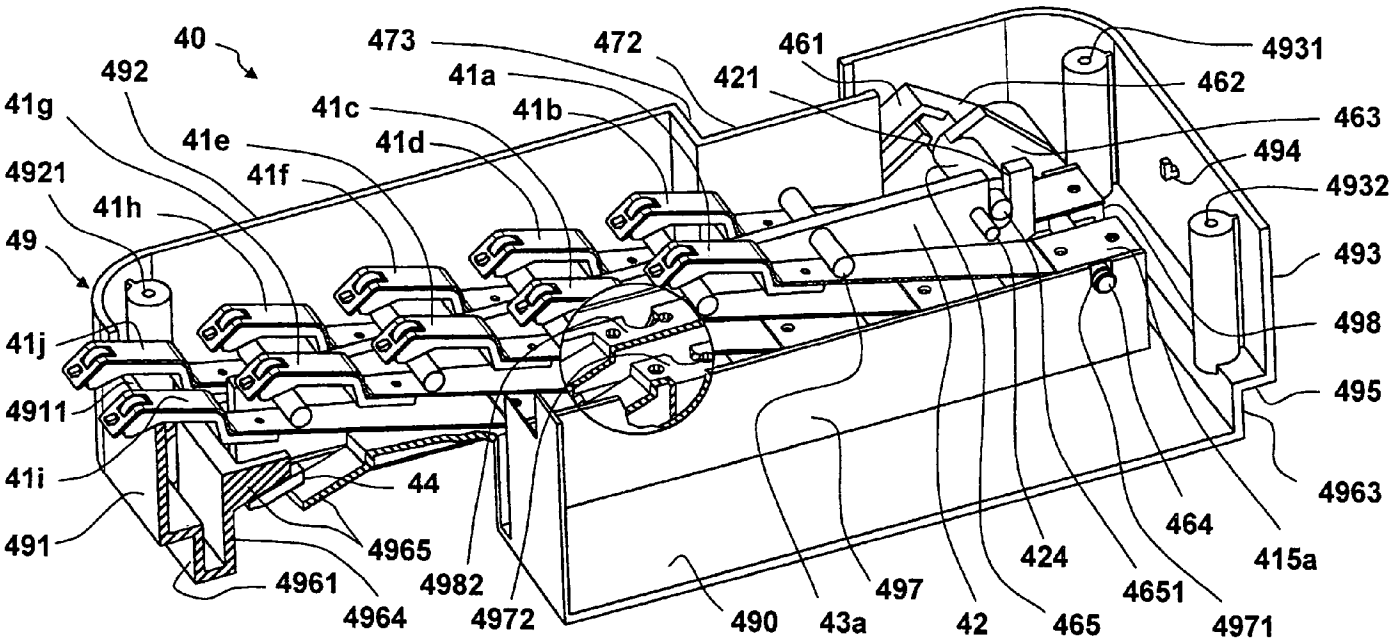
FIG. 1C is a perspective view of an apparatus for pressing flat materials onto a transport module, as seen from the rear at the top and right with lowered spring elements and with housings open at the top.

FIG. 1C shows a perspective view of an apparatus for pressing flat materials onto a transport module, as seen from the rear at the top and right, with lowered spring elements and with housings open at the top.

The pressing apparatus 40 can be moved by a slide 42 from the operating position into a second position which is shown. The spring elements 41*a* to 41*j* are disposed in two rows on both sides of the slide 42 and are anchored on the lower housing shell 49. For example, the spring element 41*a* has a base 415*a* for anchoring. The base 415*a* closes a bearing opening 4971 on one side on an angled away upper edge of a first inner wall 497 of the lower housing shell 49. A second inner wall 498, which is constructed symmetrically to the first, lies parallel to the first inner wall 497 in the lower housing shell 49, both having respective angled away upper edges 4972, 4982 which face one another.

The lower housing shell 49 has a base plate 490, on which both the first and second inner walls are formed integrally or in one piece perpendicularly and the base is formed integrally or in one piece. The base 496 has a left-hand base side wall 4963 which merges into the left-hand side wall 493 through a base step 495. The left-hand side wall 493 has a hook 494 on its inner side for fastening a non-illustrated tension spring. Fastening pillars 4931 and 4932, which lean against the left-hand side wall 493, stand on the base step 495. A further fastening pillar 4921 stands on a base step on the inner side of the transition of the front wall 492 to the right-hand side wall 491. The fastening pillars serve to fasten the feed table. The feed table and the tension spring have been omitted from the drawing of FIG. 1C, in order to increase its clarity. The base 496 has a right-hand base side wall 4961 which merges into the right-hand side wall 491 through the base step 495. A further inner wall 4964 extends on the inside parallel to the right-hand base side wall 4961. The further inner wall 4964 merges into a guide receptacle 4965 which has a guide slot that is angled away downward with respect to the transport direction by approximately 20°. The guide receptacle 4965 is shown in section so that a guide leaf 44, which is integrally formed on the slide 42 and slides in the guide receptacle, becomes visible. The lower housing shell 49 has a first number of guide receptacles of this type which are integrally formed on the angled away upper edges 4972, 4982. The slide 42 has an identical number of guide leaves 44 on its lower edge, which are distributed symmetrically on both sides. The slide 42 has a second number of fingers 43*a* to 43*j* on its upper edge, which are distributed symmetrically on both sides. The second number corresponds to the number of spring elements 41*a* to 41*j* which are used.

The indentation 47 on the front wall 492 has an indentation wall 472 parallel to the front wall 492, a right-hand indentation side wall 473 and the left-hand indentation side wall 471 with the opening 470, from which the power arm 461 of an angled lever emerges. The power arm 461 is used in this case as an actuating element, in order to displace the slide 42 counter to a spring action. An actuating force, which is transmitted according to the lever principle through the angled away arm element 462 of the angled lever to the angled away power arm 463, is exerted at a key-shaped end of the power arm 461. The angled lever is rotated about an axis which extends through a shaft 464 that is mounted rotatably in the bearing openings 4971, 4981 of the two inner walls of the lower housing shell 49. As is seen with the aid of FIG. 2, a bolt carrier 465 is formed integrally or in one piece on an angled-away load arm 463 with a bolt 4651 which slides in a slot 421 that is disposed at one end of the slide 42 at its upper edge. A pin 424 is attached next to the slot 421 for fastening a tension spring 45.

Figure 1D:
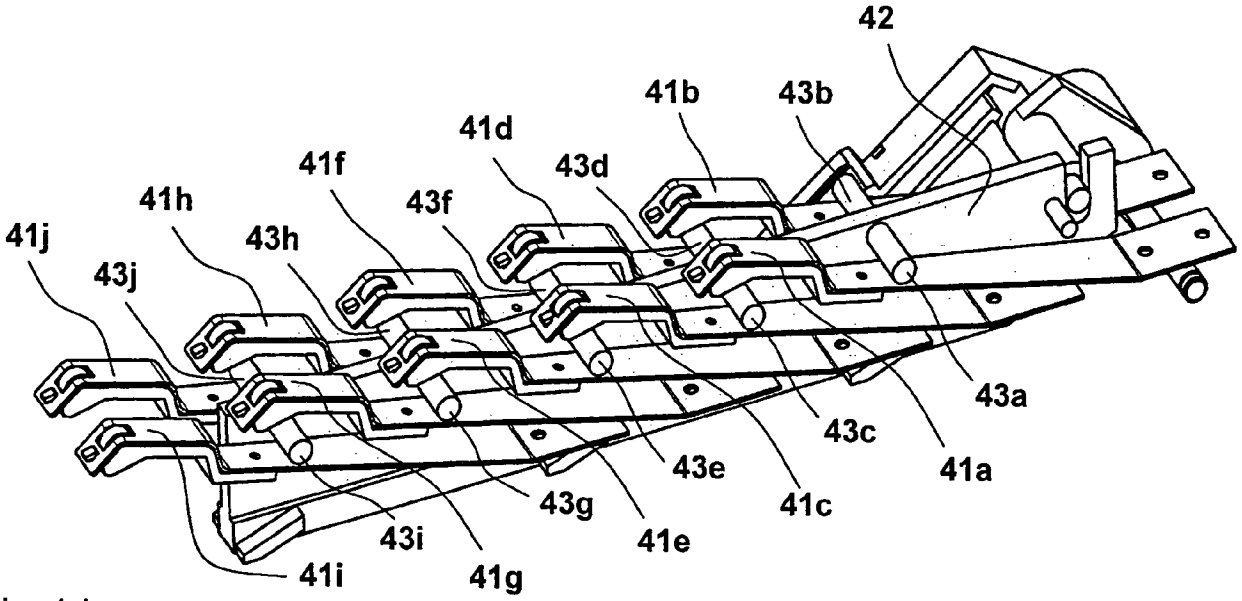
FIG. 1D is a perspective view of an apparatus for pressing flat materials onto a transport module, as seen from the rear at the top and right with lowered spring elements without housings.

FIG. 1D shows a perspective view of an apparatus for pressing flat materials onto a transport module, as seen from the rear at the top and right with lowered spring elements without housings. The spring elements 41*a* to 41*j* are shown pressed into a second position which differs from the operating position, by the fingers 43*a* to 43*j* of the slide 42.

Figure 2:
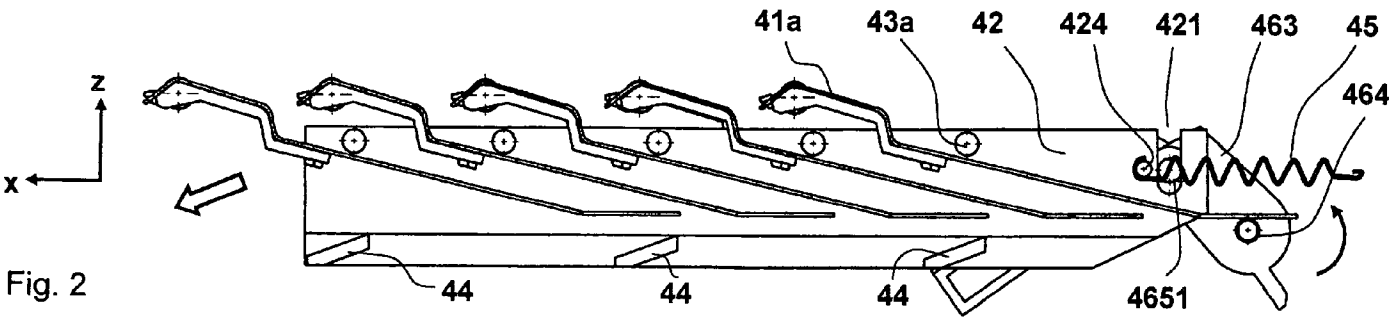
FIG. 2 is a rear-elevational view of a slide of the pressing apparatus with lowered spring elements and mounted levers.

FIG. 2 shows a rear view of the slide of the pressing apparatus with lowered spring elements and mounted levers. The slide 42 acts in an x/z-plane. The spring elements 41*a* to 41*j* are lowered by the fingers 43*a* to 43*j* of the slide 42 in the direction of the white arrow when the shaft 464 of the angled lever is rotated in the direction of the black arrow. The bolt 4651 of the load arm 463 is disposed movably in the slot 421. A rotation of the angled lever during actuation of the actuating element 46 brings about a force of the load arm 463. The force is transmitted through the bolt 4651 to the slot 421. The slide 42 is therefore also moved proportionally in the x-direction counter to the action of the force of the tension spring 45. The tension spring 45 is fastened to the lower housing shell 49 which is brought into engagement on the pin 424 of the slide 42. The slide 42 is also moved proportionally counter to the z-direction, that is to say in the direction of gravity, by the guide leaves 44 which are integrally formed on the slide 42.

Figure 3:
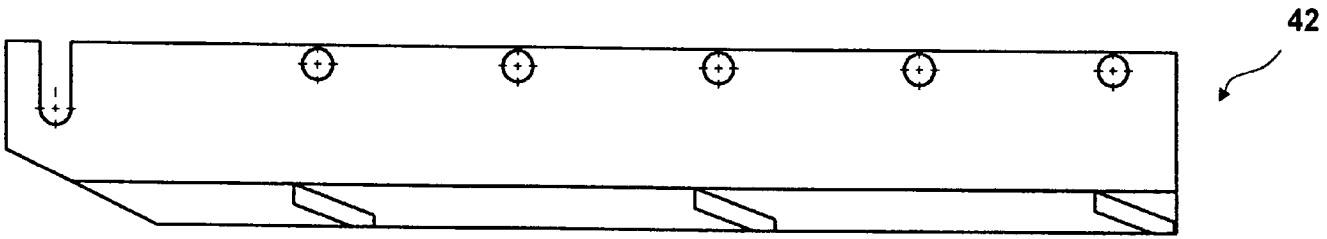
FIG. 3 is a front-elevational view of a slide of the pressing apparatus.

FIG. 3 shows a front view of the slide 42 of the pressing apparatus.

Figure 4:
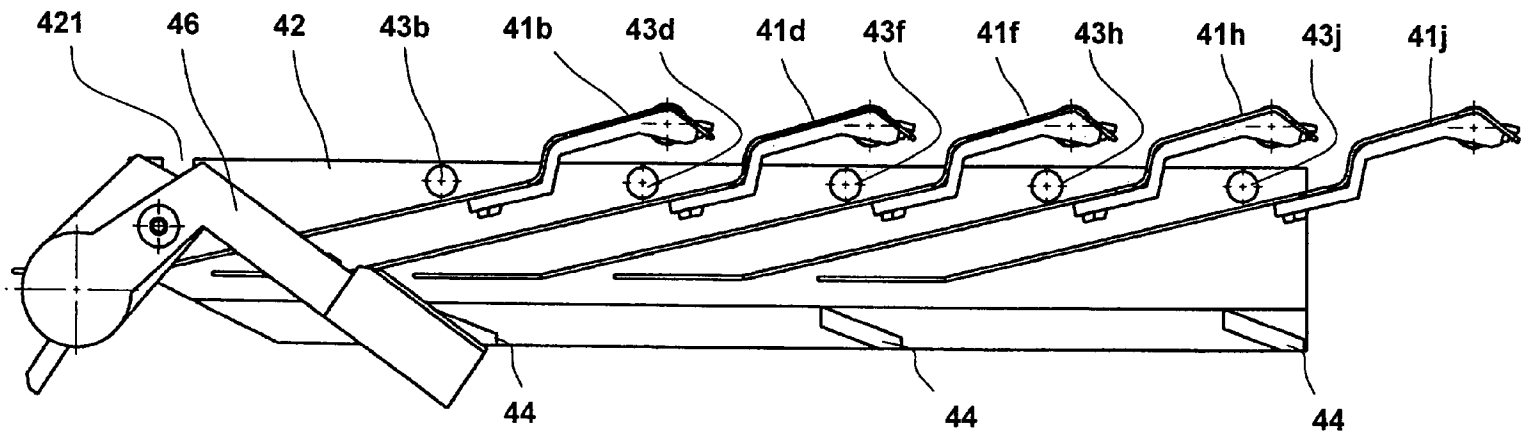
FIG. 4 is a front-elevational view of a slide of the pressing apparatus with lowered spring elements and mounted levers.

FIG. 4 shows a front view of the slide 42 of the pressing apparatus with lowered spring elements and mounted levers. The movement of the actuating element (angled lever) 46 is converted through the slot 421, which is disposed at the end of the slide 42, into a movement of the slide which is guided by guide leaves 44, with the fingers 43*b* . . . 43*j* of the slide pressing onto the spring elements 41*b* to 41*j* and lowering them downward.

Figure 5:
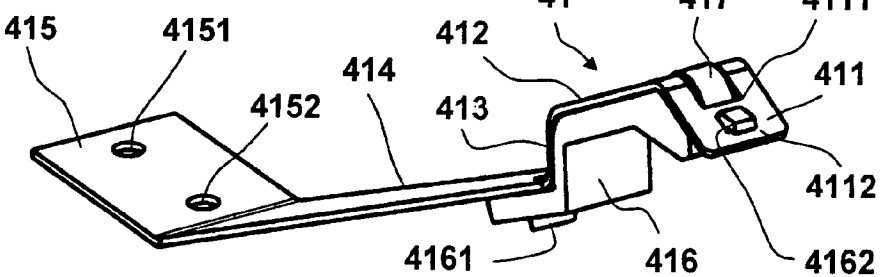
FIG. 5 is a perspective view of a spring element of the pressing apparatus.

FIG. 5 shows a perspective view of a spring element of the pressing apparatus. Each spring element 41 is composed of spring sheet steel and has a base 415 which is configured for anchoring and a head 411-413, 416 which is equipped with a device for reducing friction. The latter can include, for example, a roller 417 which is mounted rotatably in a holding device 416 that is fastened to the head. The spring sheet steel, which extends from the head to the base, can be Z-shaped or S-shaped. A first region 411 has a first opening 4111 which extends as far as into a second region 412 and is angled away from the second region 412. The first opening is provided for the roller 417. The first region 411 has a second opening 4112 at the end of the spring sheet steel for fastening the holding device 416. The holding device 416 extends through the second region 412 and a third region 413 as far as the beginning of a fourth region 414 of the spring sheet steel. A hole for a fastening bolt, fastening rivet or for a screw 4161 is provided at the beginning of the fourth region 414 of the spring sheet steel for fastening the holding device 416. The fastening can also be carried out by alternative measures.

As an alternative, the apparatus for pressing flat materials onto a transport module can also include a multiplicity of pressing elements, the number of which is substantially higher than that shown in the described exemplary embodiment. In a simplified manner, each pressing element can also be composed of a spring sheet steel which is bent in an S-shape or of another synthetic material which has spring characteristics. A material of this type should have a sufficiently smooth surface or a structure which reduces the sliding friction in the head region.

The invention is not restricted to the present embodiment per se. Rather, a number of devices are conceivable within the scope of the claims. The devices are used and are encompassed by the present claims in a manner which proceeds from the same basic concept of the invention.

The invention claimed is:

1. An apparatus for pressing flat materials onto a transport module, the apparatus comprising:

a lower housing shell;

a feed table mounted above said lower housing shell and having an opening formed therein for the flat materials;

pressing elements acting on the flat material with a spring force through said opening in said feed table, said pressing elements being configured as lowerable spring elements anchored in said lower housing shell, each of said spring elements being formed of spring sheet steel and having a base and a head;

said base being configured for anchoring, said head being equipped with a device for reducing friction and said device for reducing friction including a roller mounted rotatably on said head of said spring element;

said spring sheet steel including first, second, third and fourth regions;

said first region having a first opening extending as far as into said second region and being angled away from said second region;

said first opening being provided for said roller;

said first region having a second opening at an end of said spring sheet steel for fastening a holding device of said roller; and said holding device extending through said second and third regions as far as a beginning of said fourth region;

an actuating element disposed on said lower housing shell; and a lowering apparatus to be actuated by said actuating element, said lowering apparatus disposed in said lower housing shell and having a lever connected mechanically to said actuating element and a slide coupled to said lever for lowering said spring elements upon actuation of said actuating element.

2. The apparatus according to claim 1, wherein said spring sheet steel extends from said head to said base, is formed in an S-shape and has regions with different configurations.

3. The apparatus according to claim 1, wherein said spring sheet steel has a hole formed therein at said beginning of said fourth region for fastening said holding device with a fastening bolt, a rivet or a screw.

4. The apparatus according to claim 3, wherein:

said lower housing shell has a front wall, a right-hand side wall, a left-hand side wall and a base;

said front wall has an indentation formed therein for said actuating element;

said right-hand side wall has an upper edge with a cutout formed therein for permitting said spring elements to be lowered downstream in a mail flow direction;

said lower housing shell has inner walls configured to guide said slide; and fastening pillars for fastening said feed table are disposed on inner sides of said side walls.

5. An apparatus for pressing flat materials onto a transport module, the apparatus comprising:

a lower housing shell;

a feed table mounted above said lower housing shell and having an opening formed therein for the flat materials;

pressing elements acting on the flat material with a spring force through said opening in said feed table, said pressing elements being configured as lowerable spring elements anchored in said lower housing shell;

an actuating element disposed on said lower housing shell;

a lowering apparatus to be actuated by said actuating element, said lowering apparatus disposed in said lower housing shell and having a lever connected mechanically to said actuating element and a slide coupled to said lever for lowering said spring elements upon actuation of said actuating element;

said lower housing shell having a front wall, a right-hand side wall, a left-hand side wall and a base, said front wall having an indentation formed therein for said actuating element, said right-hand side wall having an upper edge with a cutout formed therein for permitting said spring elements to be lowered downstream in a mail flow direction, and said lower housing shell having inner walls configured to guide said slide; and fastening pillars disposed on inner sides of said side walls for fastening said feed table.

6. An apparatus for pressing flat materials onto a transport module, the apparatus comprising:

a lower housing shell;

a feed table mounted above said lower housing shell and having an opening formed therein for the flat materials;

pressing elements acting on the flat material with a spring force through said opening in said feed table, said pressing elements being configured as lowerable spring elements anchored in said lower housing shell;

an actuating element disposed on said lower housing shell; and a lowering apparatus to be actuated by said actuating element, said lowering apparatus disposed in said lower housing shell and having a lever connected mechanically to said actuating element and a slide coupled to said lever for lowering said spring elements upon actuation of said actuating element, said lever being an angled lever having a power arm, an angled-over arm element and an angled-over load arm.

7. The apparatus according to claim 6, which further comprises:

a first number of integrally formed guide leaves disposed at a lower edge of said slide and distributed symmetrically on both sides;

a second number of fingers disposed at an upper edge of said slide and distributed symmetrically on both sides, said second number corresponding to a number of said spring elements being used;

said slide having an end with a slot formed therein;

said load arm having a bolt disposed movably in said slot, causing a movement of said angled lever to be converted into a movement of said slide upon actuation of said actuating element, said movement being guided by said guide leaves and said fingers of said slide pressing onto said spring elements and lowering said spring elements downward; and a pin attached next to said slot for fastening a tension spring.

* * * * *